United States Patent [19]

Sakai et al.

[11] Patent Number: 4,669,276

[45] Date of Patent: Jun. 2, 1987

[54] MODULAR WATER SPRAYING DEVICE FOR AN ICE MAKING MACHINE

[75] Inventors: Tadashi Sakai; Tomio Suyama, both of Toyoake, Japan

[73] Assignee: Hoshizaki Electric Co., Ltd., Toyoake City, Japan

[21] Appl. No.: 840,641

[22] Filed: Mar. 17, 1986

[51] Int. Cl.[4] ..... F25C 1/12

[52] U.S. Cl. ..... 62/347; 239/124; 239/379; 239/566

[58] Field of Search ..... 62/347, 74; 239/124, 239/332, 379, 504, 566

[56] References Cited

U.S. PATENT DOCUMENTS

| | | | |
|---|---|---|---|
| 4,452,049 | 6/1984 | Nelson | 62/74 |
| 4,526,014 | 7/1985 | Suyama et al. | 62/347 |
| 4,580,410 | 4/1986 | Toya | 62/347 |
| 4,601,176 | 7/1986 | Suyama | 62/347 X |
| 4,601,178 | 7/1986 | Suyama et al. | 62/347 |

*Primary Examiner*—William E. Tapolcai

*Attorney, Agent, or Firm*—Wenderoth, Lind & Ponack

[57] ABSTRACT

A modular water spraying device for an ice making machine including a vertically extending freezing plate having an evaporator of the freezing system on its one surface and a plurality of hollow, vertically extending, spaced guide ribs on its other surface, and a water distributor disposed above the top of the freezing plate and provided with a plurality of water distributing apertures is disclosed. The modular water spraying device comprises a spray water guide member adapted to be removably mounted to the top of said freezing plate. The guide member includes a main portion adapted to be disposed between two adjacent guide ribs to receive ice making water from the water distributor and direct the received water toward the associated freezing surface section between the adjacent guide ribs; a pair of upwardly extending side portions provided on both sides of the main portion and positioned at the inside of the adjacent guide ribs when the spray water guide member is mounted to the top of said freezing plate; and a pair of holding portions extending downwards from, and to the outside of, the corresponding side portions, the holding portions being positioned into the respective ribs when the spray water guide member is mounted to the top of said freezing plate, whereby the holding portions cooperate in cooperation with the corresponding side portions to cause the main portion to be snugly disposed between the adjacent ribs.

5 Claims, 12 Drawing Figures

MODULAR WATER SPRAYING DEVICE FOR AN ICE MAKING MACHINE

BACKGROUND OF THE INVENTION

This invention relates to the structure of a modular water spraying device for ice making systems and more particularly to an improvement in such structure whereby the spray water guide member or members adapted to supply uniform ice making water to the ice making surfaces of the freezing plate can be accurately and easily mounted to or dismounted from the freezing plate.

Typical of water spraying devices heretofore employed for ice making systems are those shown in FIGS. 1 through 4.

In the structure shown in FIG. 1, the numeral 1 designates a vertically disposed freezing plate associated with an evaporator 2 of the refrigeration system. Affixed to the mounting flange 1*a* of the freezing plate 1 by set screws 1*c* is an L-shaped mounting plate 1*b* provided with a spraying device main body 3 having numerous spray apertures 3*a*.

Below the freezing plate 1 are placed a deflection guide plate 1*d* and a reservoir 1*e* for ice making water. The water in the reservoir 1*e* is introduced into the main body 3 through a circulation pump 1*f*. The water thus supplied into the main body 3 is sprayed via the spray apertures 3*a* onto each ice making surface section 1*g* of the freezing plate 1 to descend along said surface section 1*g* to form an ice product 1*h* thereon after the lapse of a predetermined time interval.

FIGS. 2 through 4 illustrate a device described in our copending application, now U.S. Pat. No. 4,601,178.

In these figures, the numeral 1 denotes a freezing plate having on its one side the evaporator 2 of the freezing system and on its other side a plurality of vertically extending spaced apart guide ribs 4. On the top of the freezing plate 1 the main body 3 of the spraying device having numerous spaced spray apertures 3*a* is mounted.

The outer sides of the main body 3 are formed with generally L-shaped, longitudinally extending mounting portions 3*b* by which spray water guide members 5 are detachably held.

Between the foremost part of the main portion 5*a* of the guide member 5 and the ice making surface 1*g* of the freezing plate 1, there is defined a gap "d" for uniformly guiding the ice making water. The spray water guide members 5 are disposed between the adjoining ones of guide ribs 4, as shown in FIG. 2. The main body 3 of the spraying device is releasably clamped to the freezing plate 1 by a pair of retaining projections 3*c* and the upright portions 5*b* of the water spray guide members 5.

The above described prior-art structure is very inconvenient in many ways. That is, in the structure shown in FIG. 1, since the spray apertures 3*a* of the main body 3 and the freezing plate 1 are excessively spaced apart from one another, the ice making water is scattered to a notably varied degree as a function of the jet direction of the ice making water relative to the freezing plate 1 and the discharge pressure of the circulation pump 1*f*, thus giving rise to water turbulence along the freezing plate 1 and obstructing the growth of a uniform ice layer. Thus, for stable ice making, it is necessary to make fine adjustment of the mounting position of the main body 3 and/or the size of the spray apertures, an operation which is troublesome in the mass production of ice products. In addition, since the position of the L-shaped mounting plate 1*b* integral with the main body 3 with respect to the main portion 1*a* of the freezing plate 1 is solely determined by set screws 1*c*, it has not been possible to obtain a highly accurate mounting position of the mounting plate 1*b*.

Furthermore, in the structure shown in FIGS. 2 to 4, since the direction of removal of the main body 3 for washing or maintenance is limited to a direction vertical to the freezing plate 1, it has been structurally impossible to dismount the water sprayer 3 transversely when the need has arisen placing an important limitation on the design of the ice product making system. Also, the respective water spray guide members 5 must be squeezed into the L-shaped mounting portion 3*b* of the main body 3, increasing the number of mounting steps which increases manufacturing costs. Moreover when the main body 3 fitted with the spray water guide members 5 is mounted to the upper edge of the freezing plate 1, the spray water guide members 5 must be clamped or sandwitched between adjoining gide ribs 4 on both sides of the evaporator 2, requiring positional adjustment of the water spray guide members 5 which entails prolonged mounting time.

SUMMARY OF THE INVENTION

It is therefore an object of the present invention to provide a modular water spraying device for an ice making machine by which the above drawbacks can be promptly overcome. From this object in view, the present invention provides a modular water spraying device for an ice making machine including a substantially vertically extending freezing plate having an evaporator of the freezing system on its one surface, the freezing plate having a plurality of hollow, vertically extending, spaced guide ribs on its other surface and a plurality of vertically extending freezing surface sections longitudinally defined between the adjacent ribs on the other surface of the freezing plate, and a water distributor disposed above the top of said freezing plate and provided with a plurality of water distributing apertures. The modular water spraying device comprises a spray water guide member adapted to be removably mounted to the top of the freezing plate and includes: a main portion adapted to be disposed between two adjacent guide ribs to receive ice making water from the water distributor and direct the received water toward the associated freezing surface section; a pair of vertically upwardly extending side portions provided on both sides of the main portion and positioned at the inside of the adjacent guide ribs when the spray water guide member is mounted to the top of the freezing plate; and a pair of substantially vertical holding portions extending downwards from, and to the outside of the corresponding side portions, the holding portions being positioned into the respective ribs when the spray water guide member is mounted to the top of the freezing plate, whereby the holding portions operate in cooperation with the corresponding side portions to cause the main portion to be snugly disposed between the adjacent ribs.

BRIEF DESCRIPTION OF THE DRAWINGS

FIGS. 1 through 4 show two examples of a prior-art water spraying device, wherein FIG. 1 is a side view showing, partly in section, one example, FIG. 2 is a fragmental front view of the other example; FIG. 3 is a sectional side view taken along line III—III of FIG. 2; and FIG. 4 is a fragmental plan view showing essential portions of the example in FIG. 2.

FIGS. 5 through 12 show the different embodiments of a water spraying device for the ice making system according to the present invention, wherein FIG. 5 is a fragmental front view of the ice making machine incorporating therein the first embodiment according to the invention; FIG. 6 is a plan view showing essential portions of FIG. 5; FIG. 7 is a sectional right side view taken along line VII—VII of FIG. 6; FIG. 8 is a perspective view of the first embodiment of the spray water guide member with a portion being cut away; FIG. 9 is a sectional side view as seen along line VIII—VIII of FIG. 8, FIG. 10 is a perspective view showing a modification of the spray water guide member; FIG. 11 is an exploded perspective view showing the paired freezing plate-spray water guide member; and FIG. 12 is a perspective view showing a further modification of the spray water guide member.

DETAILED DESCRIPTION OF THE PREFERRED EMBODIMENTS

Figure 1:
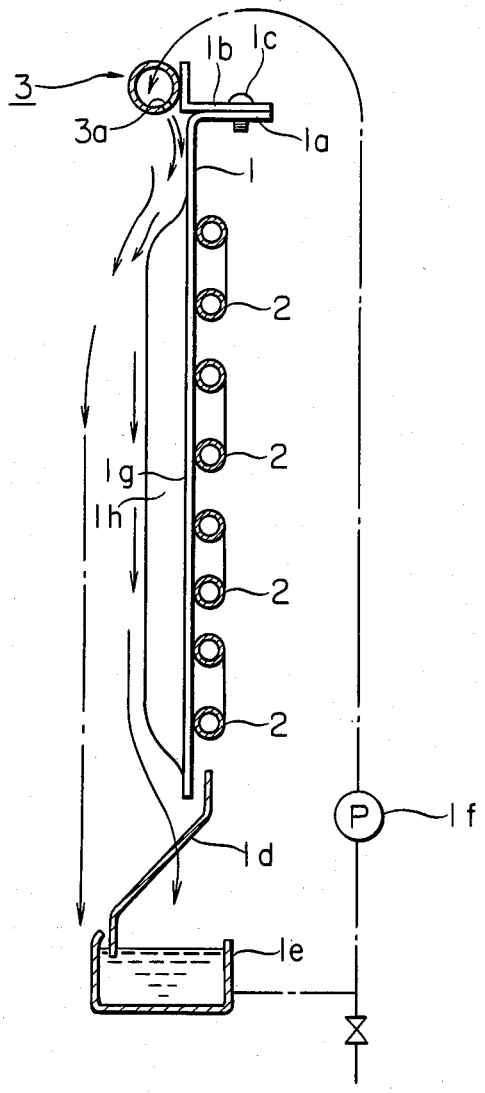
FIG. 1 (PRIOR ART)
Figure 2:
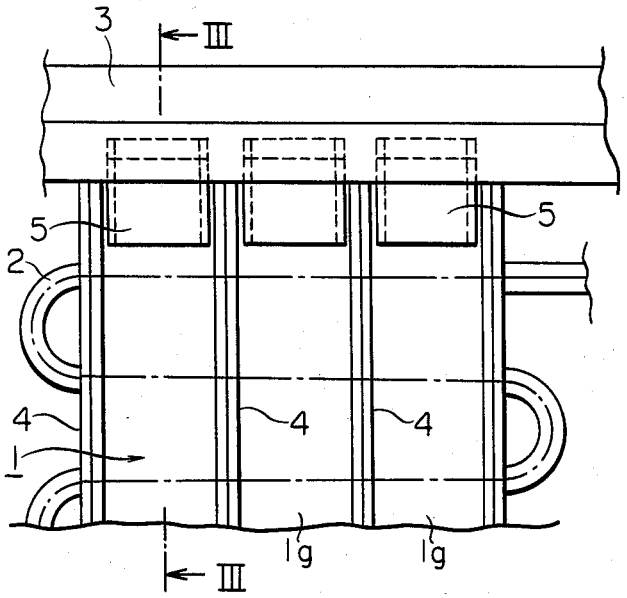
FIG. 2 (PRIOR ART)
Figure 3:
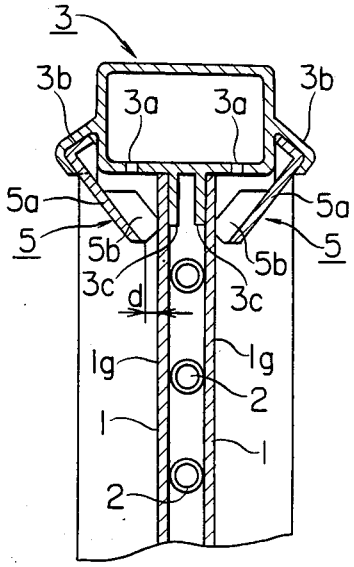
FIG. 3 (PRIOR ART)
Figure 4:
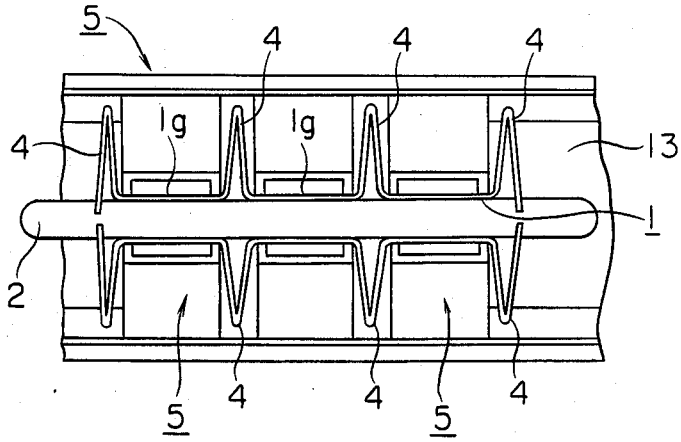
FIG. 4 (PRIOR ART)

The water sprayer for the ice making system of the present invention will be explained below by referring to the accompanying drawings.

Those parts or components similar to those shown in the above described prior-art devices are denoted by the same reference numerals.

In the drawings, the numeral 1 designates a vertically extending plate the one side of which is provided with the evaporator 2 of the freezing system. The other side of the freezing plate 1 is formed with a plurality of longitudinally extending spaced guide ribs 4 by corrugating the freezing plate 1 into a wavy configuration. Freezing surface sections 1*g* are delimited between the adjoining guide ribs 4. On top of the freezing plate 1, there is provided a horizontally extending main body 3 of the water distributor having a large number of spray apertures 3*a* and supported by a supporting structure, not shown. A plurality of spray water guide members 5 are detachably mounted to the upper edge of the freezing plate 1.

Figure 7:
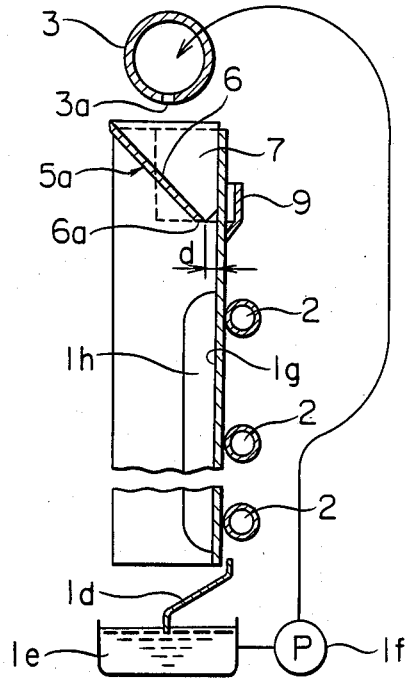

In the main portion 5*a* of the spray water guide member 5 is formed a pyramidal projection 6 having a chamfered edge 6*a* (FIG. 7) and a gap "d" for passage of the ice making water is defined between said edge 6*a* and its associated freezing surface section 1*g* of the freezing plate 1. The spray water guide members 5 are disposed between adjoining guide ribs 4 of the freezing plate 1. Each spray aperture 3*a* in the main body 3 is positioned above a corresponding spray water guide member 5 disposed between the guide ribs 4.

Figure 8:
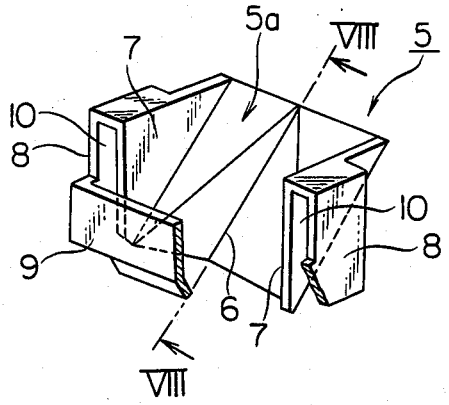
Figure 9:
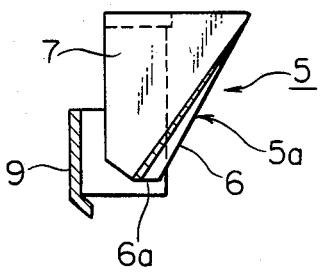

A deflection guide plate 1*d* and a reservoir 1*e* for ice making water are placed below the freezing plate 1, the water in the reservoir 1 is introduced into the main body 3 through a circulation pump 1*f*. The water thus supplied into the main body 3 is sprayed through the spray apertures 3*a* of the main body 3 to descend along the ice making section 1*g* of the freezing plate 1 to form, after a predetermined time interval, an ice product 1*h* on said ice making section 1*g*. The spray water guide member 5 is constructed as shown in the perspective view of FIG. 8 and has a pair of vertical integral side sections 7 extending upwards. The upper end parts of these side sections 7 are formed with a pair of vertical integral holding sections 8 extending downwards and connected together by a plate-like integral connecting section 9 extending transversely of the holding sections.

Figure 5:
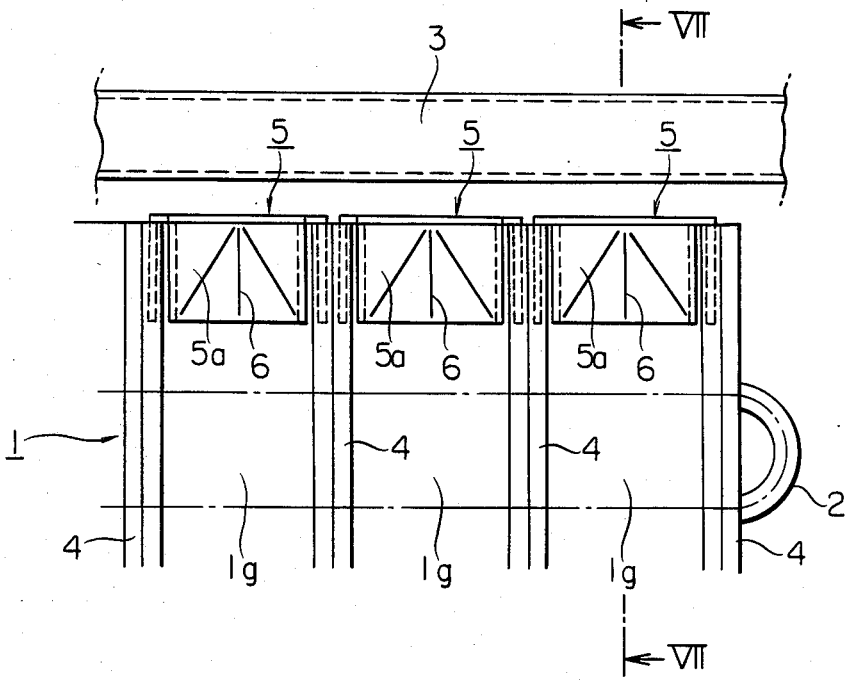
Figure 6:
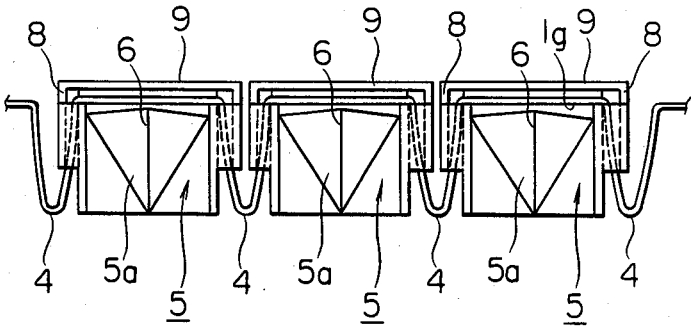

These spray water guide members 5 are detachably fitted and disposed on the upper edge of the freezing plate 2. That is, as shown in FIGS. 5 and 6, the guide ribs 4 of the freezing plate 1 are introduced into the receiving grooves 10 defined between the side sections 7 and the holding sections 8 while the spray water guide members 5 are releasably engaged between the associated guide ribs 4 by sandwiching the freezing plate 1 between the side sections 7 and the connecting section 9.

The operation of the above described water spraying device is as follows. Upon actuation of the freezing system, not shown, and the circulation pump 1*f*, the ice making water supplied under pressure to the main body 3 is sprayed to the main portion 5*a* of the guide member 5 to be divided by the angular projection 6 into left and right side streams so as to flow uniformly down along the section 1*g* without any concentration at the center. Although the above description dealt solely with a case in which freezing surface sections are formed on only one surface of the freezing plate 1, it is to be noted that similar results may be obtained even when the freezing surface sections are formed on both surfaces of the plate 1.

Figure 10:
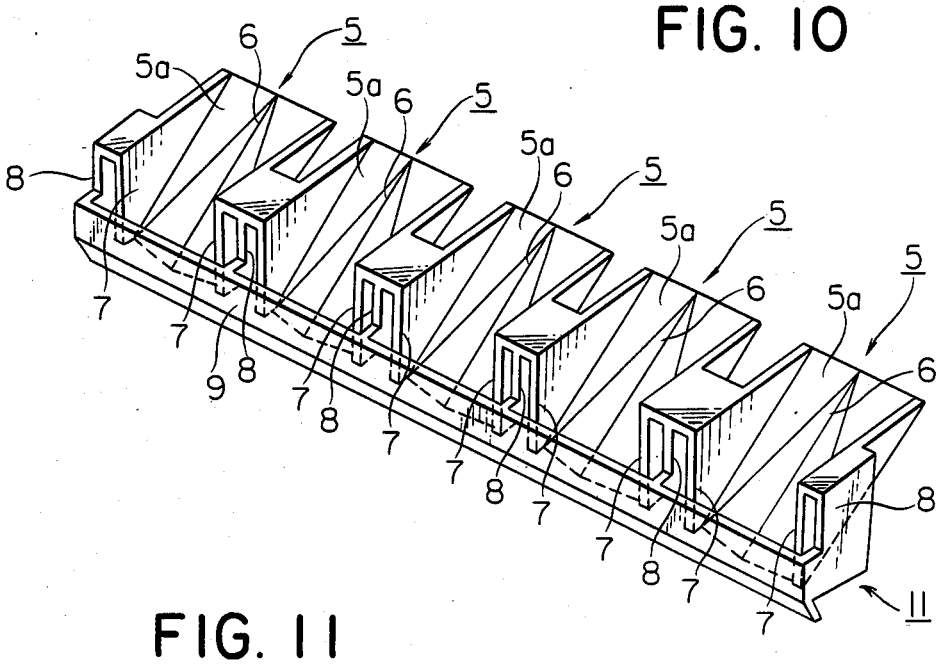

FIG. 10 shows a modified embodiment of the invention in which, when the freezing surface sections are formed only on one side of the freezing plate, a common holding section 8 is used between two transversely adjacent guide members 5 and the connecting members 9 of the guide members 5 are united together into one integral connecting member.

Figure 11:
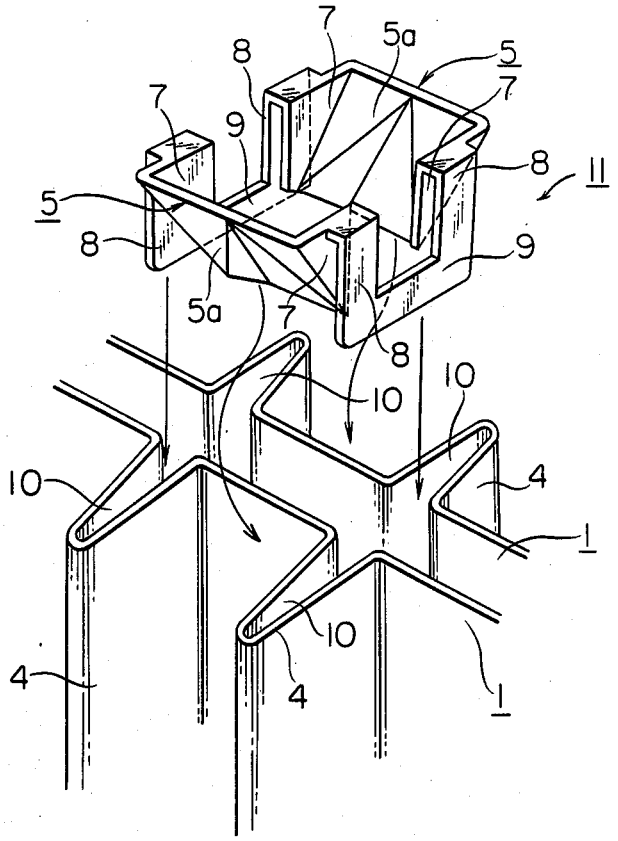

The embodiment shown in FIG. 11 is used to achieve the same result as that of the embodiments shown in FIGS. 5 through 10. A pair of freezing plates 1 are juxtaposed with each other with an evaporator coil 2 interposed therebetween, although such evaporator pipe is not shown herein. A pair of spray water guide members 5 are united together into a composite spray water guide member 11 in such a way that the each pair of holding sections 8 of said guide members 5 are connected by the corresponding connecting members 9, said guide members 5 being oriented to guide water in the opposing directions. Thus, both the holding sections 8 and the connecting member 9 can be introduced into the guide ribs 4 and the freezing plate 1 is clamped by the confronting pair of side sections 7, whereby the composite spray water guide member 11 is removably held at the upper end of the freezing plate unit 1.

Figure 12:
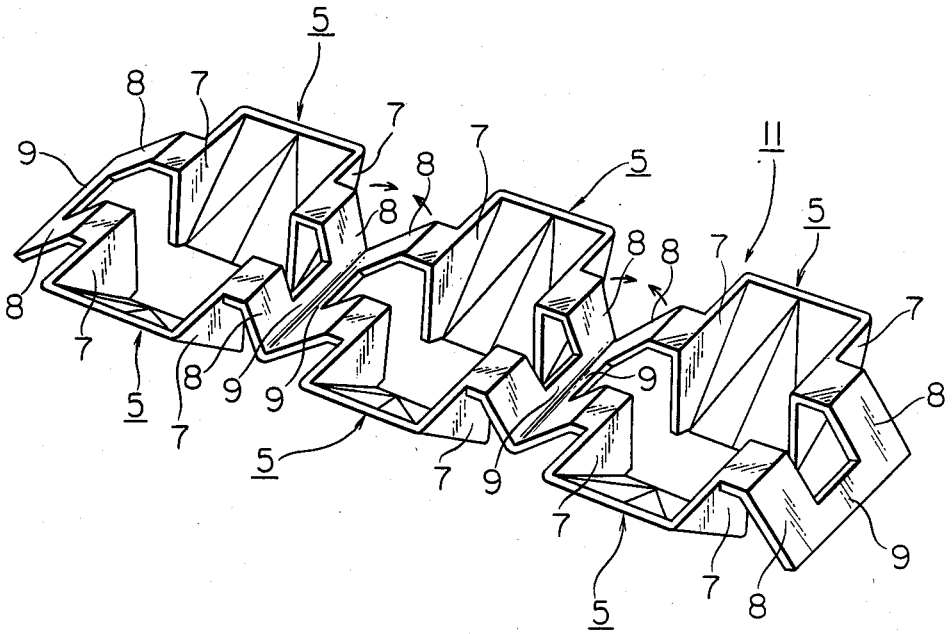

FIG. 12 shows an embodiment in which a number of the composite spray water guide members 11 shown in FIG. 11 are transversely connected into one by integrally connecting the connecting members 9 which unite the holding sections 8 of the composite spray water guide members 5.

From the above it can be seen that since the present invention provides a water spraying device for an ice making system in which the spray water guide members can be mounted after being designed and constructed so that the ice making water can flow down in an optimum manner, the guide members can be easily attached to the freezing plate without the need for any further adjustment thereof and, since the spray water guide members are attached to the upper end of the freezing plate beforehand, there are no limitations placed on the mounting of the main body of the water spraying device thus facilitating the mounting or removal of the main body while increasing a degree of design freedom.

What we claim is:

1. A modular water spraying device for an ice making machine including a substantially vertically extending freezing plate having an evaporator of a freezing system of the ice making machine on its one surface, said freezing plate having a plurality of hollow, vertically extending, spaced guide ribs on its other surface and a plurality of vertically extending freezing surface sections longitudinally defined between the adjacent ribs on the other surface of said freezing plate, and a water distributor disposed above the top of said freezing plate and provided with a plurality of water distributing apertures, said modular water spraying device comprising a spray water guide member removably mounted to the top of said freezing plate and including:

a main portion disposed between two adjacent guide ribs to receive ice making water from said water distributor and direct the received water toward the associated freezing surface section;

a pair of vertically upwardly extending side portions provided on both sides of said main portion positioned at the inside of said adjacent guide ribs; and a pair of substantially vertical holding portions extending downwards from, and to the outside of, said corresponding side portions, said holding portions being positioned in the respective ribs, whereby said holding portions operate in cooperation with said corresponding side portions to cause said main portion to be snugly disposed between the adjacent ribs.

2. The modular water spraying device according to claim 1, said spray water guide member further including a connecting portion connecting said holding portions to one another, said connecting portion being positioned on the side of said one surface of said freezing plate, whereby said connecting portion operates in cooperation with said side portions and said holding portions to cause said main portion to be snugly disposed between the adjacent ribs.

3. A modular water spraying device for an ice making machine including a substantially vertically extending freezing plate having an evaporator of a freezing system of the ice making machine on its one surface, said freezing plate having a plurality of hollow, vertically extending, spaced guide ribs on its other surface and a plurality of vertically extending freezing surface sections longitudinally defined between the adjacent ribs on the other surface of said freezing plate, and a water distributor disposed above the top of said freezing plate and provided with a plurality of water distributing apertures, said modular water spraying device comprising a plurality of spray water guide members connected in juxtaposition to one another and removably mounted between the top of said freezing plate and said water distributor, each of said spray water guide members including:

a main portion removably disposed between two adjacent guide ribs to receive ice making water from said water distributor and direct the received water toward the associated freezing surface section;

a pair of vertically upwardly extending side portions provided on both sides of said main portion and positioned at the inside of said adjacent guide ribs;

a pair of substantially vertical holding portions extending downwards from, and to the outside of, said corresponding side portions; and a connecting portion connecting said holding portions to one another;

said connecting portions of said spray water guide members being integrally formed into one common connecting portion and adjacent holding portions of adjacent spray water guide members being integrally formed into one common holding portion;

said holding portions extending into the corresponding guide ribs with said common connecting portion positioned on the side of said one surface of said freezing plate, whereby said holding portions operate in cooperation with said common connecting portion and said portions to cause each of said main portions to be snugly disposed respectively between two adjacent ribs.

4. A modular water spraying device for an ice making machine including:

first and second substantially vertically extending freezing plates, each having opposite first and second surfaces and an evaporator of a freezing system of the ice making machine on said first surface thereof, said freezing plates each having a plurality of hollow, vertically extending, spaced guide ribs on said second surface thereof and a plurality of vertically extending freezing surface sections longitudinally defined between the adjacent ribs on said second surface thereof, said first surface of said first freezing plate facing said first surface of said second freezing plate, said guide ribs of said first freezing plate being aligned with the corresponding guide ribs of said second freezing plate;

a water distributor disposed above the top of said first and second freezing plates and provided with a plurality of water distributing apertures; and a pair of spray water guide members connected in opposition to one another, removably mounted to the top of said freezing plates, each of said spray water guide members including:

a main portion disposed between two adjacent guide ribs to receive ice making water from said water distributor and direct the received water toward the associated freezing surface section;

a pair of vertically upwardly extending side portions provided on both sides of said main portion and positioned at the inside of said adjacent guide ribs;

a pair of substantially vertical holding portions extending downwards from, and to the outside of, said corresponding side portions; and a pair of connecting portions each connecting one of said holding portions of one of said paired spray water guide members to a corresponding one of said holding portions of the other of said paired spray water guide members, said corresponding connecting portions of said spray water guide members being integrally formed into one common connecting portion;

said holding portions extending into the corresponding guide ribs with said common connecting portion positioned into the aligned guide ribs of said freezing plates, whereby said holding portions operate in cooperation with said connecting portions and said side portions to cause said main portions to be snugly disposed between respective pairs of adjacent aligned ribs.

5. A modular water spraying for an ice making machine including:

first and second substantially vertically extending freezing plates, each having opposite first and second surfaces and an evaporator of a freezing system of the ice making machine on said first surface thereof, said freezing plates each having a plurality of hollow, vertically extending, spaced guide ribs on said second surface thereof and a plurality of vertically extending freezing surface sections longitudinally defined between the adjacent ribs on said second surface thereof, said first surface of said first freezing plate facing said first surface of said second freezing plate, said guide ribs of said first freezing plate being aligned with the corresponding guide ribs of said second freezing plate;

a water distributor disposed above the top of said first and second freezing plates and provided with a plurality of water distributing apertures; and plural pairs of spray water guide members connected in opposition and in juxtaposition to one another and removably mounted to the top of said first and second freezing plates, each of said paired spray water guide members including:

a main portion disposed between an adjacent two of said guide ribs to receive ice making water from said water distributor and direct the received water toward the associated freezing surface section;

a pair of vertically upwardly extending side portions provided on both sides of said main portion and positioned at the inside of said adjacent guide ribs;

a pair of substantially vertical holding portions extending downwards from, and to the outside of, said corresponding side portions; and a pair of connecting portions connecting one of said holding portions of one of said paired spray water guide members to a corresponding one of said holding portions of the other of said paired spray water guide members;

said corresponding connecting portions of said paired spray water guide members being integrally formed into one common connecting portion so that the adjacent paired spray water guide members are connected together at said corresponding connecting portions;

said holding portions extending into the corresponding guide ribs with said common connecting portion positioned into the aligned guide ribs of said freezing plates, whereby said holding portions operate in cooperation with said common connecting portions and said side portions to cause said main portions to be snugly disposed between respective pairs of adjacent aligned ribs.

* * * * *